United States Patent [19]

Badrak

[11] 4,356,034

[45] Oct. 26, 1982

[54] METHOD OF REDUCING DEFECTS IN POWDER METALLURGY TUNGSTEN CARBIDE ELEMENTS

[75] Inventor: Robert P. Badrak, Missouri City, Tex.

[73] Assignee: Reed Rock Bit Company, Houston, Tex.

[21] Appl. No.: 185,692

[22] Filed: Sep. 10, 1980

[51] Int. Cl.[3] ..... B22F 3/12

[52] U.S. Cl. ..... 75/203; 75/200; 75/221; 75/204; 148/126

[58] Field of Search ..... 75/221, 203, 204, 240, 75/200; 148/126

[56] References Cited

U.S. PATENT DOCUMENTS

| | | | |
|---|---|---|---|
| 1,833,099 | 11/1931 | Welch | 75/204 |
| 2,349,052 | 5/1944 | Ollier | 75/240 |
| 3,459,915 | 8/1969 | Swazy | 75/240 |
| 3,685,134 | 8/1972 | Blue | 75/221 |
| 3,937,630 | 2/1976 | Kimura | 75/200 |
| 3,964,878 | 6/1976 | Schecthauer, Jr. | 75/221 |
| 4,032,336 | 6/1977 | Reen | 75/224 |
| 4,121,927 | 10/1978 | Lohman | 148/126 |
| 4,225,344 | 9/1980 | Fujimori | 148/126 |

OTHER PUBLICATIONS

Schwarzkopf, P. et al., "Cemented Carbides," MacMillan, N.Y., 1960, pp. 62–65, 74–89.

*Primary Examiner*—L. Dewayne Rutledge
*Assistant Examiner*—J. J. Zimmerman
*Attorney, Agent, or Firm*—Michael J. Caddell

[57] ABSTRACT

A method is disclosed for manufacturing cutting elements of powdered tungsten carbide which involves sintering the powder into a solid element and then thermo-cycling the part to reduce internal defects.

3 Claims, 3 Drawing Figures

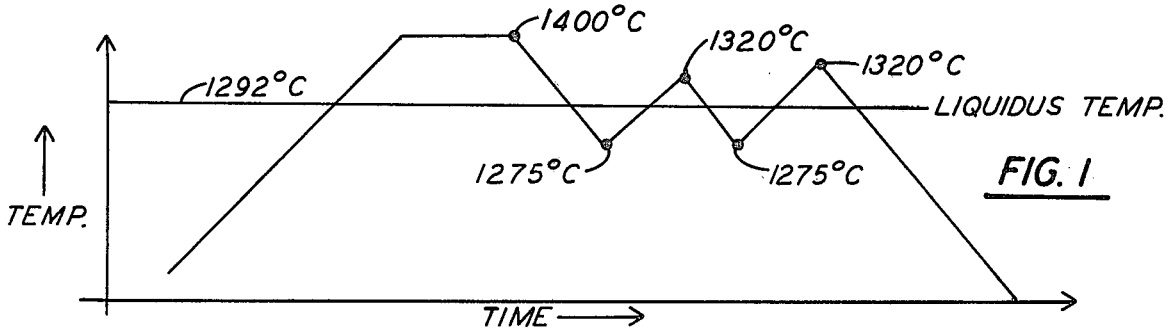
FIG. 1
FIG. 2
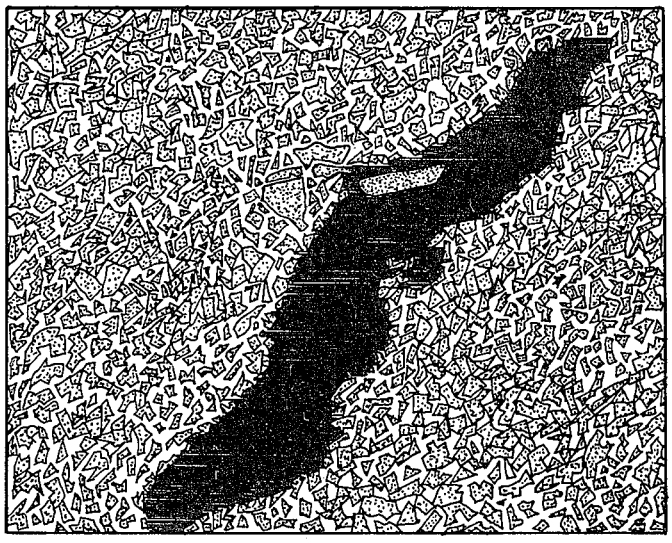
FIG. 3
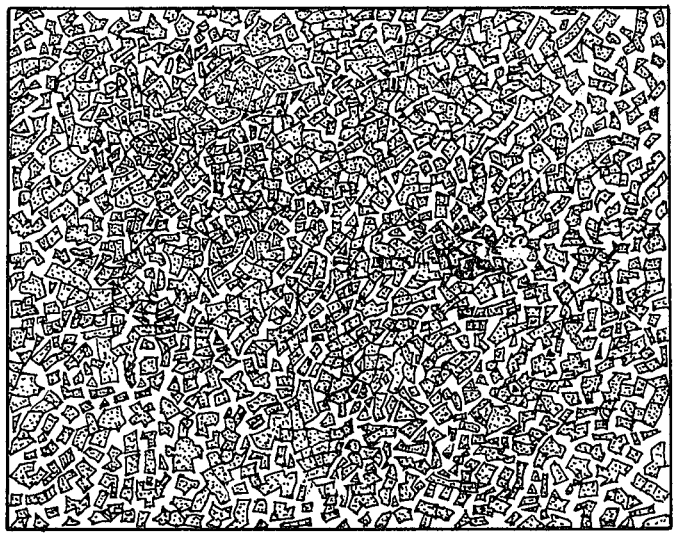

METHOD OF REDUCING DEFECTS IN POWDER METALLURGY TUNGSTEN CARBIDE ELEMENTS

BACKGROUND OF THE INVENTION

The present invention relates generally to the manufacture of components from tungsten carbide and more particularly involves an advantageous method of removing and reducing internal holes and porosity in cutting elements manufactured from sintered tungsten carbide utilizing powder metallurgy techniques. This method is particularly advantageous in the manufacture of "inserts," which are sintered tungsten carbide cutting elements utilized in the rolling cutters of an oil well or mining drill bit. Normally, these inserts are manufactured by preparing a proper mixture of powdered metal alloy containing particles of tungsten carbide and a proper matrix metal such as cobalt, then pressing the powder metal into a die having the desirable shape and heating the pressed part above the liquidus temperature of the matrix metal in order to solidify the powder metal and form the finished hard metal insert.

Tungsten carbide should be milled or ground into a fine powder and mixed with the powdered matrix metal before the forming operation is. The milling and grinding of the preformed tungsten carbide-matrix metal is a relatively critical step in the formation of the finished hard metal cutting element because of the propensity of contaminants to enter the tungsten carbide powder during this step. Normally, the grinding or milling of these pellets occurs in a steel ball mill, or other type grinding device, and because of the hard nature of tungsen carbide, a substantial quantity of impurities such as iron or steel may be abraded from the grinding machinery by the tungsten carbide particles, and as a result, will end up in the finished tungsten carbide powder. The presence of these iron and steel impurities in the tungsten carbide powder after the powder is combined with the matrix powder and sintered into a finished product will generate defects such as porosities and holes. As a result of these internal defects, the strength of the cutting element is substantially reduced and the element is unsuitable for use in critical areas such as in oil well and mining drill bits. A substantial amount of expensive tungsten carbide material is wasted unless these defects can be removed.

The conventional method of removing some microporosity and holes in sintered tungsten carbide products is a process termed, "HIPing" (Hot Isostatic Pressing). In this process the tungsten carbide cutting element is placed under high pressure and high temperature for an extended period of time to force the material to collapse or flow into the holes and porosities, thereby removing them from the internal metallic structure. In some cases, the excessive pooling of binder in areas of previous voids during HIPing render the product unacceptable. This HIPing process is time-consuming and labor intensive, and as a result, can add even more to the cost of the tungsten carbide element than the original material and manufacturing expense. As a result, a HIPed tungsten carbide insert in an oil well or mining drilling bit costs more than a normally made tungsten carbide insert which had no internal defects and did not require HIPing.

The present invention discloses a method of greatly reducing and in some cases, even eliminating microporosity and holes in the internal structure of tungsten carbide inserts without the need for expensive hot isostatic pressing techniques. This is achieved by the use of thermo-cycling of the tungsten carbide insert after it has been pressed into shape and sintered, and prior to cooling of the insert after sintering.

BRIEF DESCRIPTION OF THE DRAWINGS

FIG. 1 is a time-temperature graph illustrating the process of the present invention. FIGS. 2 and 3 are photomicrographs of the metallic internal structure of tungsten carbide cutting elements.

DESCRIPTION OF THE PREFERRED EMBODIMENT

In the present invention, a process is disclosed for reducing or eliminating holes in sintered tungsten carbide inserts. In the preferred embodiment, the invention is practiced by thermo-cycling of the sintered hard metal element to remove the porosities and holes. The thermo-cycling is schematically illustrated in graphic form in FIG. 1. In a typical thermo-cycling process, a powdered metallurgy insert is formed using conventional powder metallurgy techniques by pressing the powder to shape and then sintering at a temperature above the solidus line of the matrix metal. This sintering process, which is widely used in the carbide industry, is called "liquid phase sintering". In one embodiment, a tungsten carbide hard metal material was mixed with a cobalt powder matrix and the resulting liquidus temperature was 1292° C. The conventional sintering step occurred at 1400° C. for a period sufficient to sinter the entire component. Thus, the temperature of the tungsten carbide component was lowered to a point below the liquidus temperature, in the range of 1200°-1290° C. The temperature was then raised back above the liquidus temperature to some point in the range of 1300°-1350° C. Then the temperature was again cycled to the lower point below the liquidus and finally was raised again above the liquidus temperature. This completed the thermo-cycling of the tungsten carbide element and the temperature was allowed to cool back to room temperature. An examination of this tungsten carbide insert by photomicrographs revealed that a large reduction in porosity was achieved, as well as an almost total elimination of the internal holes in the part. A comparison was made with a similar insert made from the same powder lot and under the same pressing and sintering conditions, and a substantial reduction in the B-type porosity, as well as an elimination of substantially all of the internal holes was achieved in the thermo-cycled insert. Because of this significant improvement in the internal structure of this component due to the thermo-cycling process, there was no further requirement of hot isostatic pressing of the inserts in these sample lots.

FIG. 2 illustrates a photomicrograph of a sintered tungsten carbide insert prior to the thermo-cycling process of this invention. As can be seen from this photomicrograph, there are a large number of internal holes existing in the sintered product. Under normal conventional manufacturing techniques, this insert would be unacceptable in the drilling industry without first subjecting it to the HIPing process previously described. This process is time and labor intensive and, as a result, adds a substantial element of increased costs to the final product.

FIG. 3 is a photomicrograph of a cross-section of an insert manufactured identically to that of FIG. 2, but which has had an additional step of thermo-cycling. It is readily apparent from examining the photomicrograph of FIG. 3 that the large number of holes which otherwise would have been present have been reduced and eliminated by the thermo-cycling process. Preferably, the cycling of the sintered tuhngsten carbide element occurs in a vacuum, inert gas, or hydrogen atmosphere. The inventor suspects the thermo-cycling process is successful in reducing porosity and internal holes in sintered tungsten carbide elements, as a result of a cyclic melting and refreezing process internally in the metal structure, resulting in rupturing the void boundary around the hole or porosity, which dramatically changes the stress state and deforms that void boundary. Also, because of the time the cemented tungsten carbide experienced at elevated temperatures below the liquidus, an increased amount of material migration occurring through solid state diffusion takes place. Although the thermo-cycling process has been exhibited to be very successful in reduction of porosity and internal holes when the presinered tungsten carbide powders contain iron contaminants, the success of the thermo-cycling process cannot be as successfully demonstrated when the contaminants in the tungsten carbide powder are of an organic nature.

Thus, in typical operation, the present process can be introduced into the tungsten carbide insert manufacturing process with little additional complexity or trouble. For example, in the process represented by FIG. 1 in which a tungsten carbide cobalt powder mix having a liquidus temperature of 1292° C. was formed into a tungsten carbide cutting element by compacting the pre-mixed powders into the desired shape and then raising the temperature into the range of 1400° C., a sintered tungsten carbide is the result of this first step. Normally, the tungsten carbide insert will be maintained at the sintering temperature for a period of time in the range of 15 minutes to an hour. This successfully consolidates the compacted powder into a single integral cemented tungsten carbide element. At this point in time, the conventional insert manufacturing process would call for cooling the sintered insert to room temperature and then testing a sample of each insert lot to determine the need for HIPing, or another rework procedure. In some instances, because of the large amount of contaminants found in the powders used to manufacture the inserts, the sintered inserts will have high porosity and a large number of internal holes. If the porosity and number of holes found in the sampling of inserts is unacceptable, then the inserts must be removed from the manufacturing assembly line and transported to a HIPing facility or location within the plant. There the inserts must be subjected to the hot isostatic pressing techniques to remove the unacceptable voids located therein. Utilizing the present invention, the manufacturing process is merely expanded slightly to incorporate the thermo-cycling steps as an automatic manufacturing procedure performed on each insert after the normal sintering process. Thus, all manufactured inserts will be pressed into shape from the desired milled and blended powders and then sintered at the normal sintering temperature of around 1400° C. for the necessary length of time, usually running from 15 minutes to one hour, and then the temperature of the lot of inserts is lowered to a point 5°–50° below the solids temperature. Then the lot of inserts is raised above the solids temperature approximately 5°–50°, then lowered again below the liquidus temperature, then raised again above the liquidus temperature, and so on until the thermo-cycling step is completed. Although two cycling steps have been illustrated and described and the differential temperature above and below the liquidus temperature is illustrated as around 10 to 25°, the process can be varied by varying the differential temperature and/or varying the number of cycles across the liquidus temperature line.

After the combination of the sintering step with the thermo-cycling step, the inserts are then sampled and tested for porosities and holes. The manufacturing process has not been complicated by the thermo-cycling step and the only change over the conventional manufacturing process has been the additional time required for the elements in the furnace or heating area. This additional time is required for the raising and lowering of the insert temperatures across the solidus temperature line. After cooling the inserts to near room temperature, samples can be taken similar to the sampling done in the conventional process to determine if the porosities and internal holes still remain. As mentioned previously, when the contaminants in the pre-sintered powders are of an iron or steel nature, the thermo-cycling process is extremely successful in removing voids and porosity caused thereby, but when the voids are a result of organic contaminants such as plastics, then the thermo-cycling step may not be successful in reducing the voids and porosity, and the inserts must still be transported to the HIPing facility for further treatment. It has been found that prior to introduction of the thermo-cycling step into the insert manufacturing process, that, in some huge powder lots, up to 90 percent of the sintered inserts had to be transported to the HIPing facility for further treatment to reduce unacceptable voids and porosities. After introducing thermo-cycling into the manufacturing process, these huge powder lots resulted in zero voids and reduced porosities thereby eliminating the requirement for further HIPing of the inserts.

The following Table 1 illustrates five different insert lots, designated A through E, manufactured from five different large powder lots on a standard insert production line. In the first three columns next to the insert group column are samples drawn from the powdered lots immediately after the standard sintering process. These columns indicate that at least four of the five powder groups, i.e., groups A through D, had unacceptable numbers of holes and/or porosity in each insert. In the last three columns, figures are shown for the same insert groups formed of the same powder lots after the inserts had been subjected to the thermo-cycling process. The number of holes per insert and the average porosity are shown in the last three columns for the thermo-cycled inserts. In all cases, the number of holes have been reduced substantially or totally eliminated, thereby making the insert acceptable with respect to this characteristic. Likewise, a slight reduction of the A porosities and B porosities is also exhibited in most of the samples.

TABLE I

| INSERT GROUP | STANDARD SINTERED INSERTS NO. INSERTS | NO. HOLES | POROSITY | THERMO-CYCLED NO. INSERTS | NO. HOLES | POROSITY |
|---|---|---|---|---|---|---|
| A | 2 | 140 | $A_2B_3$* | 2 | 0 | $A_1B_1$ |
| B | 20 | 200 | $A_3B_2$* | 6 | 0 | $A_1B_1$ |
| C | 20 | 210 | $A_1B_1$* | 6 | 3 | None |
| D | 20 | 14 | None* | 6 | 1 | $B_1$ |
| E | 20 | 4 | $B_1$* | 4 | 0 | None |

[Porosity is measured on the following basis: A porosity defines voids of 0 to 10 microns. B porosity defines voids from 10 to 40 microns. Holes are defined as voids in excess of 40 microns. The sub-numbers below the porosity symbols indicate the level of porosity present, with the numbers ranging from 1 to 5, wherein 1 is low and 5 is high.]

Thus, it can be seen from Table I that insert groups from five large powder lots showed substantial reductions in the number of holes and slight reductions in porosities in almost all cases. The level of porosity and the number of holes in all but one group of the thermo-cycled inserts is well within acceptable limits, whereas those of insert groups A through D, which were only sintered, were not acceptable. It is believed by this inventor that the thermo-cycling process has not shown a significant impact on the porosity. However, it may be that the remaining porosity in the thermo-cycled inserts are former voids which have been reduced from hole size to small porosities by the thermo-cycling step. If this is the case, then this effect is also desirable because of eliminating the large detrimental effect of the holes as compared to the smaller effect of porosities.

Although a specific preferred embodiment of the present invention has been described in the detailed description above, the description is not intended to limit the invention to the particular forms of embodiments disclosed therein since they are to be recognized as illustrative rather than restrictive, and it will be obvious to those skilled in the art that the invention is not so limited. For example, whereas the particular alloy of the cemented tungsten carbide insert illustrated has a solidus temperature of about 1290° C. and a sintering temperature of 1400° C. with a thermo-cycling range of about 1240° C. to about 1350° C., with two thermo-cycles, it is believed that any powder metallurgy process using liquid-phase sintering could benefit from the thermo-cycling technique. Also, varying the number of thermo-cycling steps, the cycling temperatures, and/or the surrounding atmosphere can be performed during the thermo-cycling of sintered tungsten carbide to vary the results. Thus, the invention is declared to cover all changes and modifications of the specific example of the invention herein disclosed for purposes of illustration which do not constitute departure from the spirit and scope of the invention.

The embodiments of the invention in which an exclusive property or privilege is claimed are defined as follows.

1. A method of manufacturing a cemented carbide insert for use in a drill bit for underground drilling and substantially reducing the voids therein without HIPing, said method consisting of the steps of:

mixing the desirable amount of binder or matrix metal and carbide fractions of powdered metal into a substantially homogeneous mixture;

shaping the desired amount of said mixture to obtain the desired finished shape, size and density of insert, sintering the shaped insert at a temperature and time sufficient to densify the homogeneous powder mixture;

lowering and raising the temperature of the sintered insert across the solidus temperature line of said insert at least one time, and then cooling the insert to room temperature.

2. A method of reducing the internal holes and porosity in a sintered metallic carbide element of preselected finished shape, said method consisting of the steps of:

cycling said element across the solidus temperature line of the sintered carbide material in said element, at least one cycle after sintering, and then cooling the treated element to room temperature.

3. The method of claim 2 wherein said cycling step comprises bringing said element to a temperature of around 5 to 50 degrees centigrade below the solidus temperature of said element, then raising the temperature of said element to a range of around 5 to 50 degrees centrigrade above said solidus temperature, before cooling said element.

* * * * *

UNITED STATES PATENT AND TRADEMARK OFFICE

CERTIFICATE OF CORRECTION

PATENT NO. : 4,356,034

DATED : October 26, 1982

INVENTOR(S) : Robert J. Badrak

It is certified that error appears in the above-identified patent and that said Letters Patent is hereby corrected as shown below:

In the Drawings:

Fig. 1 - the word "LIQUIDUS" should be "SOLIDUS."

Col. 1, line 21 - the word "liquidus" should be "solidus."

Col. 2, lines 29, 34, (35 - 36), 38, and 39 - the word "liquidus" should be "solidus."

Col. 3, line 6 - the word "tuhngsten" should be "tungsten."

Col. 3, lines 19 and 34 - the word "liquidus" should be "solidus."

Col. 4, lines 2 and 3 - the word "solids" should be "solidus."

Col. 4, lines 4, 5, 10 and 14 - the word "liquidus" should be "solidus."

Signed and Sealed this

*Twenty-second* Day of *February 1983*

[SEAL]

*Attest:*

GERALD J. MOSSINGHOFF

*Attesting Officer*

*Commissioner of Patents and Trademarks*